United States Patent [19]

Hartmann et al.

[11] 4,210,690

[45] Jul. 1, 1980

[54] SPUN NONWOVEN FABRIC OF POLYESTER FILAMENTS FOR USE AS BACKING MATERIAL FOR A DEEP-DRAWABLE TUFTED CARPET

[75] Inventors: Ludwig Hartmann; Ivo Ruzek, both of Kaiserslautern, Fed. Rep. of Germany

[73] Assignee: Firma Carl Freudenberg, Weinheim, Fed. Rep. of Germany

[21] Appl. No.: 947,287

[22] Filed: Sep. 29, 1978

[30] Foreign Application Priority Data

Aug. 5, 1978 [DE] Fed. Rep. of Germany ..... 2834438

[51] Int. Cl.[2] ..... D05C 17/00

[52] U.S. Cl. ..... 428/95; 156/167; 156/181; 428/288; 428/296; 428/375; 428/395

[58] Field of Search ..... 428/95, 288, 296, 297, 428/375, 395; 156/167, 181

[56] References Cited

U.S. PATENT DOCUMENTS

| | | | |
|---|---|---|---|
| 3,338,992 | 8/1967 | Kinney | 264/210 F |
| 3,595,731 | 7/1971 | Davies et al. | 428/296 |
| 3,687,759 | 8/1972 | Werner et al. | 156/181 |
| 3,691,004 | 9/1976 | Werner et al. | 156/181 |
| 3,692,618 | 9/1972 | Dorschner et al. | 156/181 |
| 3,837,988 | 9/1974 | Hannen et al. | 468/95 |

*Primary Examiner*—James J. Bell

*Attorney, Agent, or Firm*—Sprung, Felfe, Horn, Lynch & Kramer

[57] ABSTRACT

A spun nonwoven fabric of polyester filaments for use as backing for a deep-drawable tufted carpet, wherein the polyester filaments hve uniformly distributed therethrough about 0.1 to 1% by weight of a diol-modified copolyester containing units of at least two different doils. For example, polyethylene terephthalate granulate is mixed with polyethylene butylene terephthalate copolymer and spun into a nonwoven web which is calendered and then tufted to form a carpet which can be deep-drawn with a three-dimensional shape. If desired, polyethylene terephthalte-adipate copolymer fibers can be co-spun into the web as binding fibers.

7 Claims, 1 Drawing Figure

FLOWSHEET FOR THE MANUFACTURE OF MODIFIED POLYESTER SPUN NONWOVENS

FLOWSHEET FOR THE MANUFACTURE OF MODIFIED POLYESTER SPUN NONWOVENS
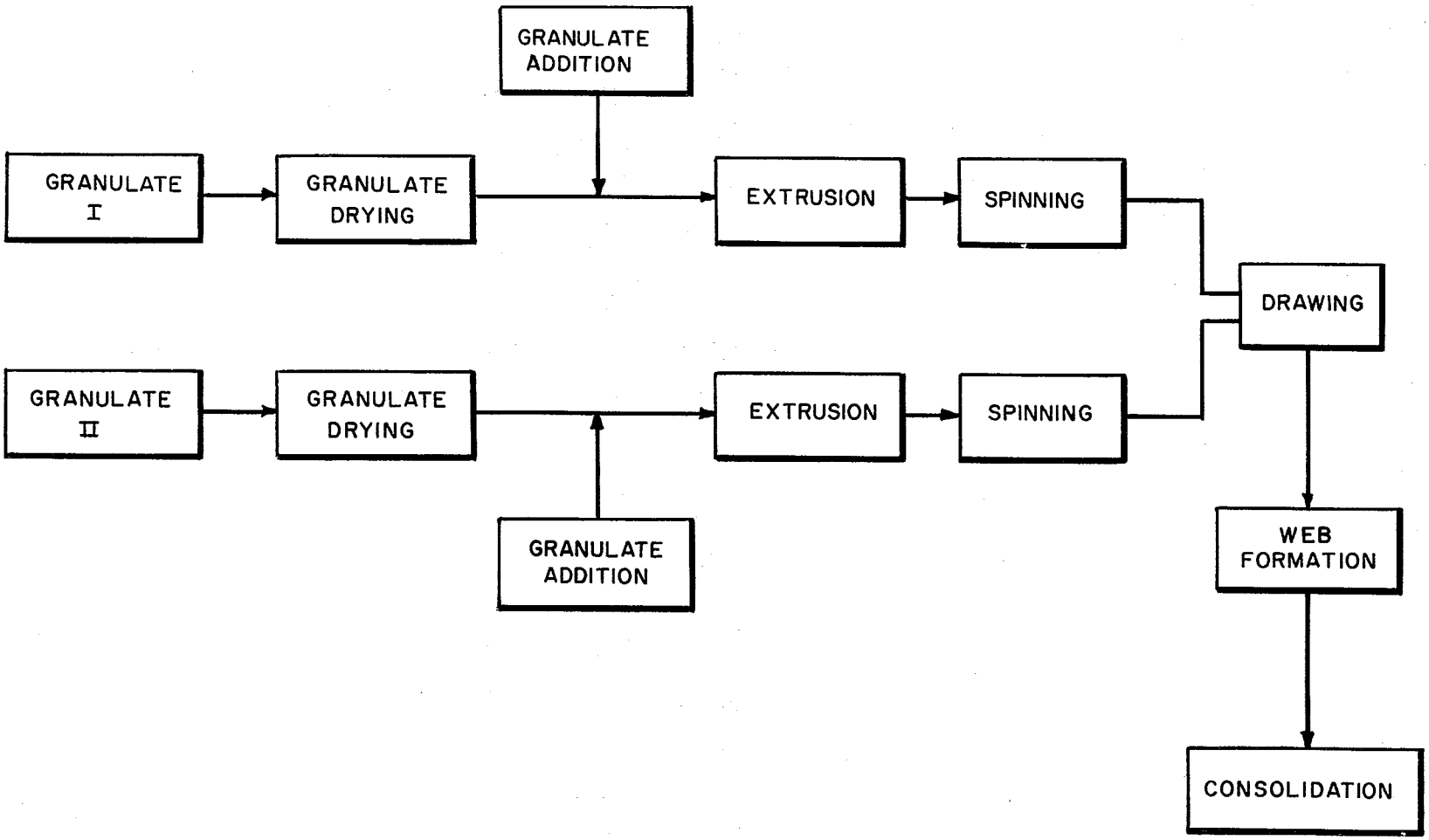

SPUN NONWOVEN FABRIC OF POLYESTER FILAMENTS FOR USE AS BACKING MATERIAL FOR A DEEP-DRAWABLE TUFTED CARPET

The invention relates to a spun nonwoven fabric of polyester filaments for use as a backing material for a deep-drawable tufted carpet.

For the manufacture of tufted automobile carpets capable of being shaped three-dimensionally, a backing material is needed which on the one hand has high dimensional stability in the finished state and on the other hand can readily be shaped so as to conform to the particular contours of the automobile construction.

The invention has as its object to provide a spun non-woven fabric for use as backing material for a tufted carpet which in addition to particularly good deep-drawability has high dimensional stability.

This object is accomplished in a spun nonwoven fabric of the type described above in that the polyester filaments contain, uniformly distributed, about 0.1 to 1% of a diol-modified copolyester.

In one particular variant, the diol-modified copolyester contains about 10 to 100 mole percent of an $\alpha,\omega$w-diol, based on the diol component. In another advantageous variant, the $\alpha,\omega$-diol is propanediol-1,3; 2-methylpropanediol-1,3; butanediol-1,4; 2-methylbutanediol-1,4; 2,2-dimethylbutane-diol-1,4; 2,3-dimethylbutanediol-1,4; pentanedoil-1,5; 3-methylpentanediol-1,5; or 3,3-dimethylpentanediol-1,5.

With regard to the manufacture of such a spun nonwoven fabric, the use of a process has been found particularly advantageous in which a polyethylene terephthalate granulate is melted in at least one spinning extruder and by the use of a spinneret spun into a row of filaments which are drawn by means of drawing air streams and collected on a web permeable to air and united into a nonwoven fabric, provided that a diol-modified copolyester granulate is fed to the extruder together with the polyethylene terephthalate granulate and that the intermixing of the two components occurs in the extruder.

Thus the filaments of the spun nonwoven fabric in accordance with the invention are composed of a chemically modified polyester, and they exhibit a clearly altered crystallization behavior. As a direct result of this, it is possible to shape the nonwoven fabric in tufted or untufted form at considerably higher temperatures than has been possible up to now. At the same time good dimensional stability is obtained at the temperatures which normally prevail in an automobile.

The spun nonwoven fabrics in accordance with the invention are further distinguished by very good strength. Thus the addition has no adverse effect on the physical parameters which are of primary importance with regard to the subsequent tufting operation or the later wearing properties.

The performance of the tufting operation imposes considerable mechanical stresses on any backing material since the pile loops are anchored in the nonwoven complex by means of the tufting needles. The spun nonwoven fabric in accordance with the invention withstands these stresses extremely well, and this makes it possible to insert the pile loops very closely spaced in the spun nonwoven fabric, which amounts to an improvement of the pile density.

With regard to the manufacture of the spun nonwoven fabric there are no major departures from known processes. Both the spinning and the directly following solidification by thermal action may be carried out without negative influences.

The spinning operation is appropriately carried out in such a way that two dissimilar polyesters are spun through adjacent spinnerets, the filaments in the form of parallel rows being both drawn and uniformly mingled in a linear drawing-off means.

This mode of operation is illustrated in accompanying the FIGURE which is a flow diagram of the process.

As shown in the FIGURE, two different polyester granulates, I and II, are separately dried, additions made thereto, extruded, spun and then drawn together to form a web which is thereafter consolidated.

As granulate additives, diol-modified copolyesters containing about 10 to 100 mole percent of the diols may be used.

Through the addition of these substances prior to spinning, the crystallization behavior of the spun nonwovens is improved in a particularly advantageous manner, and after the shaping at elevated temperatures fast sudden through-crystallization of the filaments occurs.

This results immediately after the web formation in a complex of extraordinary dimensional stability. Surprisingly, this effect is produced in the entire filament complex of the spun nonwoven fabric even though acid-modified copolyesters are used as binding-fiber components, e.g. about 10 to 50% by weight of binding fiber which in turn contains about 10 to 90% of units of at least two different acids.

It seems essential for the purpose of the present invention that a heterogeneous modification of the base polymer be involved. The modifying component must form evenly distributed inclusions in the melt which after solidification can influence crystallization.

It is of considerable importance that the component modifying the crystallization behavior be added in a definite ratio to the base polymer. It has been found that this proportion must be between about 0.1 and 1 weight percent. A smaller amount has no practical effect. A larger amount affects the melting behavior of the polyester adversely.

In certain applications it has proved advantageous, moreover, to add to the diol-modified copolyester such pigments as may be needed for spin dying, if such is desired.

Practical Example

In a spun bonding installation set up in accordance with the flow sheet drawing, a spun nonwoven fabric was made from two types of polyester filaments. The matrix filaments, which accounted for 80 weight percent, were made of polyethylene terephthalate. (Granulate I in drawing) In the manufacture of binding filaments, the polyethylene-terephthalate coadipate with 20 mole percent of adipic acid was used. The binding filaments accounted for 20 weight percent. (Granulate II.)

Both granulates were dried separately in two-stage stationary air dryers, the residual moisture being less than 0.01%. Following the drying of the granulates, and ahead of the particular spinning extruder, the modifying component of a polyethylene cobutylene 1,4-terephthalate was added to the granulate streams. The molar ratio of ethylene glycol to butanediol-1,4 was 3:2. To each granulate stream 0.5 weight percent of the modifying component was added. Both granulate streams were melted by means of the spinning extruder, good mixing of the base and modifying components being secured by the use of hydrodynamic mixing equipment. The melt was then fed to the individual spinnerets which were alternately connected to the two spinning circuits.

The spinning conditions are presented in the table which follows:

Table 1

| Starting material | Spinning circuit 1 Polyethylene terephthalate | Spinning circuit 2 Polyethylene-terephthalate coadipate |
|---|---|---|
| Relative viscosity | 1.380 | 1.420 |
| Crystalline melting point (°C.) | 257 | 202 |
| Drying temperature (°C.) | 177 | 127 |
| Spinning temperature (°C.) | 285 | 262 |
| Weight percent | 80 | 20 |
| Number of filaments | 110 | 42 |
| Titer of filaments (dtex) | 11 | 7 |

After being laid down to form a web, the filaments were thermally bonded to one another in a two-stage bonding process, the first stage being carried out at 130° C. and the second stage at 210° C. The first stage was carried out by means of a heated calender, the second with a perforated-drum apparatus.

The spun nonwoven fabric was tufted with spun polyamide yarn on a tufting loom with a gauge of 31.5 needles per 10 cm ($\frac{1}{8}$") so that the resulting cutpile had 650 g/m$^2$ yarn.

The strength parameters of the spun nonwoven fabric are presented in Table 2.

Table 2

| | Untufted Lengthwise/ Crosswise | Tufted Lengthwise/ Crosswise |
|---|---|---|
| Weight per unit area (g/m$^2$) | 120 | 770 |
| Maximum tractive force according to DIN 53875 (N) | 220/210 | 226/186 |
| Maximum tractive elongation according to DIN 53857 (%) | 35/38 | 42/40 |

After being coated with polyethylene (about 500 g/m$^2$), the carpet was deep-drawn and shaped, sharp-edged level differences of 100 mm being produced over a width of 100 mm. The backing material sustained no damage as a result. The cooled shaped article exhibited a high degree of stiffness.

A shaped article which had been manufactured without being modified with said copolyester posed difficulties in deep-drawing and did not possess adequate stiffness.

It will be appreciated that the instant specification and claims are set forth by way of illustration and not limitation, and that various modifications and changes may be made without departing from the spirit and scope of the present invention.

We claim:

1. A spun nonwoven fabric of polyester filaments for use as backing for a deep-drawable tufted carpet, wherein the polyester filaments have uniformly distributed therethrough about 0.1 to 1% by weight of a diol-modified copolyester containing units of at least two different diols; the diol composition of the copolyester differing from that of the polyester.

2. A spun nonwoven fabric according to claim 1, wherein the diol-modified copolyester contains about 10 to 100 mole percent of an $\alpha,\omega$-diol, based on the diol component, which $\alpha,\omega$-diol is different from that of the $\alpha,\omega$-diol in the predominantly polyester filaments.

3. A spun nonwoven fabric according to claim 2, wherein the $\alpha,\omega$-diol is propanediol-1,3; 2-methylpropanediol-1,3; butanediol-1,4; 2-methylbutanediol-1,4; 2,2-dimethylbutanediol-1,5; 3-methylpentanediol-1,5 or 3,3-dimethylpentanediol-1,5.

4. A spun nonwoven fabric according to claim 3, wherein the polyester filaments comprise polyethylene terephthalate, and the $\alpha,\omega$-diol modified copolyester is the terephthalate.

5. A spun nonwoven fabric according to claim 4, wherein the polyester filaments comprise about 10 to 50% by weight of polyester binding fiber other than polyethylene terephthalate, about 10 to 90% of the acid units of the binding fiber being at least of two different acids.

6. A spun nonwoven fabric according to claim 5, carrying tufting and heat shaped into a three-dimensional structure.

7. A process for the manufacture of a spun nonwoven fabric according to claim 1, comprising feeding a polyethylene terephthalate granulate to a spinning extruder, feeding to the extruder a granulate of the diol-modified copolyester, melting both granulates in the extruder, spinning the melt through a spinneret to form a row of filaments, drawing the filaments by air streams, collecting the drawn filaments as a web permeable to air, and uniting the web into a nonwoven fabric.

* * * * *